US009999247B2

(12) United States Patent
Ruscio et al.

(10) Patent No.: US 9,999,247 B2
(45) Date of Patent: Jun. 19, 2018

(54) AEROSOL GENERATING DEVICE WITH HEATER ASSEMBLY

(71) Applicant: Philip Morris Products S.A., Neuchatel (CH)

(72) Inventors: Dani Ruscio, Cressier (CH); Olivier Greim, Villars-Burquin (CH); Julien Plojoux, Geneva (CH)

(73) Assignee: PHILIP MORRIS PRODUCTS S.A., Neuchatel (CH)

( * ) Notice: Subject to any disclaimer, the term of this patent is extended or adjusted under 35 U.S.C. 154(b) by 722 days.

(21) Appl. No.: 14/354,337

(22) PCT Filed: Oct. 24, 2012

(86) PCT No.: PCT/EP2012/071083

§ 371 (c)(1),
(2) Date: Apr. 25, 2014

(87) PCT Pub. No.: WO2013/060743

PCT Pub. Date: May 2, 2013

(65) Prior Publication Data

US 2014/0301721 A1 Oct. 9, 2014

(30) Foreign Application Priority Data

Oct. 25, 2011 (EP) ..... 11250870

(51) Int. Cl.
*A01G 13/06* (2006.01)
*H05B 3/58* (2006.01)
(Continued)

(52) U.S. Cl.
CPC ..... *A24F 47/008* (2013.01)

(58) Field of Classification Search
CPC ..... A24F 47/008; A24F 47/002; A61M 15/06
(Continued)

(56) References Cited

U.S. PATENT DOCUMENTS 2,597,195 A * 5/1952 Smith ..... A61L 9/127 392/395
3,389,538 A * 6/1968 Carel ..... G01N 30/12 392/397
(Continued)

FOREIGN PATENT DOCUMENTS

CN 1190335 A 8/1998
CN 201127292 Y 10/2008
(Continued)

OTHER PUBLICATIONS

Office Action dated Jun. 15, 2016 in Japanese Patent Application No. 2014-537599 (with English language translation).
(Continued)

*Primary Examiner* — Dana Ross
*Assistant Examiner* — Ket D Dang
(74) *Attorney, Agent, or Firm* — Oblon, McClelland, Maier & Neustadt, L.L.P.

(57) ABSTRACT

An aerosol generating device is provided, including a housing configured to receive an aerosol-forming substrate having an internal cavity; a heating element configured to be received within the internal cavity of the substrate, and a positioning mechanism coupled to the heating element and to the housing being configured to move the heating element between a plurality of heating positions within the cavity. There is also provided an aerosol generating device including a housing configured to receive an aerosol-forming substrate, a heating element configured to heat a portion of the substrate, and a positioning mechanism configured to move the heating element from a first position next to a first portion of the substrate, to a second position remote from the substrate, and then to a third position next to a second portion of the substrate.

16 Claims, 5 Drawing Sheets

(51) Int. Cl.
*A24F 1/22* (2006.01)
*A24F 47/00* (2006.01)

(58) Field of Classification Search
USPC ..... 219/535, 538, 539, 260; 392/390, 391, 392/386, 392, 393, 394, 395; 131/194, 131/197, 195, 196, 335, 273, 128, 200.14, 131/202.21, 203.26, 203.27, 330; 338/306, 310, 318, 319; 128/202.21, 128/203.27, 204.23, 204.24; 239/44, 49, 239/50
See application file for complete search history.

(56) References Cited

U.S. PATENT DOCUMENTS

| | | | | |
|---|---|---|---|---|
| 3,436,525 | A * | 4/1969 | Stanford | A47F 1/06 219/214 |
| 4,947,875 | A * | 8/1990 | Brooks | A24F 47/006 128/202.21 |
| 5,144,962 | A | 9/1992 | Counts et al. | |
| 5,269,327 | A | 12/1993 | Counts et al. | |
| 5,372,148 | A * | 12/1994 | McCafferty | A24F 47/008 128/202.21 |
| 5,591,368 | A | 1/1997 | Fleischhauer et al. | |
| 5,611,359 | A * | 3/1997 | Ogura | A24C 5/31 131/68 |
| 5,934,289 | A | 8/1999 | Watkins et al. | |
| 6,053,176 | A | 4/2000 | Adams et al. | |
| 7,726,320 | B2 * | 6/2010 | Robinson | A24F 47/008 131/194 |
| 2003/0007787 | A1 * | 1/2003 | Rymer | A61L 9/037 392/395 |
| 2005/0045193 | A1 | 3/2005 | Yang | |
| 2005/0196159 | A1 * | 9/2005 | Zobele | A61L 9/037 392/390 |
| 2007/0256697 | A1 | 11/2007 | Yang | |
| 2008/0085103 | A1 * | 4/2008 | Beland | A61L 9/035 392/390 |
| 2011/0126848 | A1 | 6/2011 | Zuber et al. | |
| 2011/0155718 | A1 | 6/2011 | Greim et al. | |

FOREIGN PATENT DOCUMENTS

| | | | |
|---|---|---|---|
| EP | 0 430 559 | | 6/1991 |
| EP | 2 327 318 | | 6/2011 |
| EP | 2 340 730 | | 7/2011 |
| JP | 3-192677 | A | 8/1991 |
| JP | 3-232481 | A | 10/1991 |
| JP | 3-277265 | A | 12/1991 |
| JP | 5-115272 | A | 5/1993 |
| JP | 6-315366 | A | 11/1994 |
| JP | 11-164679 | A | 6/1999 |
| JP | 2002-514910 | A | 5/2002 |
| JP | 2013-509160 | A | 3/2013 |
| JP | 2013-511962 | A | 4/2013 |
| JP | 2013-516160 | A | 5/2013 |
| RU | 2132629 | C1 | 7/1999 |
| WO | WO 2011/050964 | A1 | 5/2011 |
| WO | WO 2011/063970 | A1 | 6/2011 |
| WO | WO 2011/079933 | A1 | 7/2011 |

OTHER PUBLICATIONS

Extended European Search Report dated Jul. 10, 2012 in Patent Application No. 11250870.0.
International Preliminary Report on Patentability dated Apr. 29, 2014 in PCT/EP2012/071083.
International Search Report dated Apr. 24, 2013 in PCT/EP12/071083 Filed Oct. 24, 2012.
Written Opinion of the International Searching Authority dated Apr. 24, 2013 in PCT/EP12/071083 Filed Oct. 24, 2012.
Combined Chinese Office Action and Search Report dated Nov. 2, 2015 in Patent Application No. 201280052506.6 (with English Translation).
Decision to Grant a Patent dated Jun. 28, 2017 in Japanese Patent Application No. 2014-537599 (with English language translation).
Russian Notice of Allowance with English translation dated Mar. 27, 2018 in corresponding Russian Patent Application No. 2014121013, (13 pages).

* cited by examiner

NEW SUBSTRATE ?
755
NO
YES
EXPAND HEATER ELEMENT
700
DETECT FLOW
705
POWER ON
710
POWER OFF
715
INCREASE PUFF COUNT
720
SUBSTRATE USED ?
725
YES
NO
RETRACT HEATER ELEMENT
730
MOVE HEATER ELEMENT
735
EXPAND HEATER ELEMENT
740
RETRACT HEATER ELEMENT
745
MOVE HEATER ELEMENT TO START POSITION
750

AEROSOL GENERATING DEVICE WITH HEATER ASSEMBLY

CROSS REFERENCE TO RELATED APPLICATION

This application is a national phase application based on PCT/EP2012/071083, filed on Oct. 24, 2012.

TECHNICAL FIELD

The present invention relates to an aerosol generating device with an improved heater assembly. The invention finds particular application in an electrically operated smoking system as a heater assembly for heating an aerosol-forming substrate.

DESCRIPTION OF THE RELATED ART

Patent application U.S. Pat. No. 5,269,327 discloses an electrical smoking article comprising a plurality of charges of tobacco flavor medium which are heated sequentially to provide individual puffs. The sequential heating can be provided either by a plurality of individually activated heater elements or portions of a heater element, or by a single movable heater element.

It would be advantageous to provide an aerosol generating system that improves on these known schemes for heating an aerosol-forming substrate by providing a more developed, compact and efficient solution.

SUMMARY

According to one aspect of the invention there is provided an aerosol generating device, comprising: a housing configured to receive an aerosol-forming substrate having an internal cavity; a heating element, the heating element configured to be received within the internal cavity of the aerosol-forming substrate; and a positioning mechanism coupled to the heating element, the positioning mechanism configured to move the heating element between a plurality of heating positions within the internal cavity.

The use of a movable heating element within the aerosol-forming substrate means that efficient heating can be accomplished with minimal heat losses. The use of a heating element within the aerosol-forming substrate also means that the external diameter of the device can be minimized because insulation is not necessary as compared to externally positioned heater elements. The distance that the heating element is required to move within the aerosol-forming substrate can be made very small, and is smaller than would be required to move between corresponding portions of the substrate if the heating element were positioned externally of the aerosol-forming substrate.

The positioning mechanism may be coupled to the housing. Preferably, the positioning mechanism further comprises an engagement mechanism. The engagement mechanism is configured to move the heating element towards or away from an interior surface of the internal cavity. More preferably, the engagement mechanism is configured to move the heating element into or out of contact with the interior surfaces of the aerosol-forming substrate. This allows for efficient thermal transfer from the heating element to the aerosol-forming substrate during heating. The engagement mechanism also allows for smooth movement between heating positions when the heating element is not activated, and for easy insertion and removal of the aerosol-forming substrate.

The heating element may be placed in direct thermal contact with the aerosol-forming substrate or may be positioned close to the substrate without contacting it. Alternatively, the heating element may be in indirect contact with the aerosol-forming substrate. For example, a conductive layer may be provided between the heating element and the aerosol-forming substrate. The conductive layer may be a foil layer that conducts heat from the heating element to the aerosol-forming substrate but prevents damage to the aerosol-forming substrate caused by movement of the heating element. It may also spread the heat contact area or contact force so as not to damage the aerosol-forming substrate.

Advantageously, the heating element is heated electrically. However, it is possible to use other heating schemes to heat the heating element, for example by heat conduction from another heat source or by magnetic induction heating of the heating element.

The internal cavity of the aerosol-forming substrate can be of any size and shape provided that the heating element and any necessary parts of the positioning mechanism can be received within it. Preferably, the device is configured to receive an aerosol-forming substrate that is substantially tubular. Preferably, the tubular aerosol-forming substrate defines a hole extending through at least a portion of its length and the positioning mechanism is configured to move the heating element to different positions along this portion of the length of the aerosol-forming substrate.

It could be desirable for electrically heated smoking devices to mimic as far as possible a conventional lit-end combustible cigarette. By moving the heating element longitudinally (that is, along the length of the device) to heat different sections of the aerosol-forming substrate within the device, a large number of individual puffs can be achieved without impacting the diameter of the device. Accordingly, the device can be made to closely mimic the shape of a conventional lit-end combustible cigarette. Moving the heater circumferentially to heat separate sections of the aerosol-forming substrate is an alternative option in accordance with the present invention.

Preferably, the heating element is substantially ring shaped or circular. This is particularly advantageous when the heating element is configured to move along the length of a tubular aerosol-forming substrate. A ring shaped or circular heating element can efficiently heat a corresponding ring shaped or circular section of the aerosol-forming substrate.

Preferably, the heating element is resilient, and so returns to its original shape after being bent, compressed or stretched. Preferably, the engagement mechanism is attached to at least one end of the heating element. The engagement mechanism is configured to move the at least one end of the heating element in order to radially expand or contract the heating element. The engagement mechanism may comprise a radial arm attached to the end of the heating element and configured to pivot about a longitudinal axis. In this way the radial arm is moved to expand or contract the heating element.

According to another aspect of the invention, there is provided an aerosol generating device, comprising: a housing configured to receive an aerosol-forming substrate; a heating element configured to heat a portion of the aerosol-forming substrate; and a positioning mechanism configured to move the heating element from a first position next to a first portion of the aerosol-forming substrate, to a second position away from the aerosol-forming substrate and then to a third position next to a second portion of the aerosol-forming substrate.

The aerosol-forming substrate may be movable relative to the housing or may remain stationary relative to the housing during operation of the positioning mechanism.

In a device in which a heating element is moved relative to an aerosol-forming substrate to heat different portions, it has been difficult to efficiently heat the aerosol-forming substrate. The present invention provides heating positions for the heating element next to the aerosol-forming substrate so that efficient heating can be achieved. It also allows the heating element to be moved away from the aerosol-forming substrate to allow the heating element (or aerosol-forming substrate) to move relative to one another without damaging the heating element or aerosol-forming substrate. This allows a new portion of the aerosol-forming substrate to be heated.

Preferably, the device is configured to receive a aerosol-forming substrate that is substantially tubular. The aerosol-forming substrate could have a longitudinal axis, with the third position longitudinally spaced from the first position.

Preferably, the heating element is substantially ring shaped or circular. This is particularly advantageous when the heating element is configured to move along the length of the aerosol-forming substrate. A ring shaped, helical or circular heating element can efficiently heat a corresponding ring shaped, helical or circular section of the aerosol-forming substrate.

The heating element may be positioned externally of the aerosol-forming substrate in the first, second and third positions. More preferably, the aerosol-forming substrate comprises a tubular portion, and the heating element is configured to be positioned internally of the tubular portion in the first, second and third positions.

Preferably the heating element is resilient, and so returns to its original shape after being bent, compressed or stretched. Preferably, the positioning mechanism is attached to at least one end of the heating element. For a helical or ring shaped heating element, the positioning mechanism is configured to move that at least one end of the heating element in a circumferential direction in order to radially expand or contract the heating element. The heater element has a substantially fixed length. By moving one end of the heater element in a circumferential direction relative to the other end, the radius of curvature of the heater element can be changed. This allows the heating element to be moved towards and away from the aerosol-forming substrate. This mechanism can be used both if the heating element is positioned internally of the aerosol-forming substrate and if the heating element is positioned externally of the aerosol-forming substrate. If the heating element is external to the aerosol-forming substrate, the heating element can be configured to clamp and release the aerosol-forming substrate. Similarly, if the heating element is internal to the aerosol-forming substrate, it can be configured to move into contact and out of contact with an interior surface of the aerosol-forming substrate. The positioning mechanism may also comprise a rigid radial arm attached at a first end of the heating element and configured to pivot about a second end. In this way the end of the radial arm is moved circumferentially.

According to a further aspect of the invention there is provided an aerosol generating device comprising: a housing configured to receive an aerosol-forming substrate having an internal cavity; a heating element, the heating element configured to be received within the internal cavity of the aerosol-forming substrate; and a positioning mechanism, the positioning mechanism configured to move the heating element towards and away from an interior surface of the internal cavity.

Preferably, the positioning mechanism is configured to move the heating element into and out of contact with the interior surface of the internal cavity. This allows for efficient thermal transfer from the heating element to the aerosol-forming substrate during heating. It also allows for easy insertion and removal of the aerosol-forming substrate. The device may comprise a plurality of heating elements. The heating elements may extend along the length of the internal cavity. The positioning mechanism may be configured to move the heating element or elements circumferentially within the internal cavity of the substrate.

Preferably, the heating element is substantially ring shaped or circular. Preferably, the heating element is resilient and the positioning mechanism is attached to at least one end of the heating element. The positioning mechanism is configured to move that end of the heating element in a circumferential direction in order to radially expand or contract the heating element. The positioning mechanism may comprise a radial arm attached to the end of the heating element and configured to pivot about a longitudinal axis. In this way the end of the radial arm is moved circumferentially to expand or contract the heating element.

According to a still further aspect of the invention, there is provided a method of heating an aerosol-forming substrate, comprising: moving a heating element into contact with or close to a first portion of a surface of the aerosol-forming substrate; activating the heating element to heat a first portion of the aerosol-forming substrate; moving the heating element away from the surface of the aerosol-forming substrate; moving the heating element into contact with or close to a second portion of the surface of the aerosol-forming substrate; and activating the heating element to heat a second portion of the aerosol-forming substrate.

The heating element may be ring shaped or helical and so have a radial extent, and the step of moving the heating element into contact with and away from the aerosol-forming substrate may comprise expanding and contracting the radial extent of the heating element.

The heating element may be positioned within an internal cavity of the aerosol-forming substrate. Alternatively, or in addition, the heating element may be positioned externally of the aerosol-forming substrate.

Each of the steps of moving the heating element may be performed by operating a positioning mechanism coupled to the heating element.

In each of the aspects of the invention, the positioning mechanism may be mechanically activated or electronically activated. The device may include a microcontroller. The microcontroller may be configured to control the supply of electrical power to the heating element. In addition, the microcontroller may be configured to activate the positioning mechanism following the supply of predetermined amount or duration of electrical power to the heating element.

In each of the aspects of the invention, the positioning mechanism may be entirely mechanical and rely on a user to manually move an element on the device to operate the positioning mechanism. Alternatively, the positioning mechanism may be driven automatically using an electrically powered mechanism, such as an electromagnetic, electrostatic or piezoelectric actuation mechanism. Alternatively, the positioning mechanism may be driven by a combination of mechanical and electrical mechanisms. The positioning mechanism may also include a ratchet or other means to ensure that the same portion of the aerosol-forming substrate cannot be heated twice.

The heating element requires a supply of energy. Preferably, in the first, second, third and fourth aspects of the invention, the positioning mechanism is configured to conduct electricity to the heating element. The positioning mechanism therefore preferably comprises low resistivity, but mechanically rigid materials, such as copper. However, separate wiring may alternatively be provided to supply electrical energy to the heating element.

Preferably, the heating element has a comparatively higher resistivity in order to give rise to a significant Joule heating effect, and may be formed from a various materials, including materials such as a Nichrome™ alloy or Titanium alloy and others which may have similar properties. The heating element typically has a resistivity ranging between 140 and 170 micro-ohm per centimeter. As previously described, it also desirable for the heating element to be resilient and to have suitable mechanical strength so as to provide a robust and reliable heating arrangement over many cycles of use. This is an important factor when choosing a material giving the required resistance.

In each of the aspects of the invention, the device may comprise a plurality of heating elements. The device may comprise two, three, four or more heating elements. The positioning mechanism may be configured to move some or all of the heating elements. The device may include a first heating element configured to be received within an internal cavity of the aerosol-forming substrate and a second heating element configured to be positioned externally of the aerosol forming substrate. The positioning mechanism may be configured to move the first and second heating elements in a coordinated fashion so that the first and second heating elements are positioned to simultaneously heat the same or different portions of the aerosol-forming substrate.

The still further aspect of the invention may comprise moving a plurality of heating elements, simultaneously or sequentially, to heat the same or different portions of the aerosol-forming substrate, The heating elements may be positioned internally or externally, or both internally and externally, of the aerosol-forming substrate.

In each of the aspects of the invention, the operating or working temperature of the heating element may be approximately 50° C. to 500° C. Depending on the aerosol forming substrate, preferably the operating temperature or working temperature of the heating element may be 50° C. to 100° C. For other aerosol forming substrates, preferably the operating temperature or working temperature of the heating element may be 250° C. to 300° C. The temperature must be sufficiently high to form an aerosol with desired droplet size while significantly reducing the risk of, or avoiding, pyrolysis and combustion. The operating temperature range needed to form an aerosol and avoid pyrolysis and combustion is dependent on the different aerosol forming substrate components, their combinations and the contact surface of the heater configuration. However, a temperature range between 50° C. and 500° C. would be adequate to form an aerosol while significantly reducing the risk of, or avoiding, pyrolysis and combustion.

As is known to those skilled in the art, an aerosol is a suspension of solid particles or liquid droplets in a gas, such as air. In the first, second, third and fourth aspects of the invention, the aerosol-forming substrate preferably comprises a tobacco-containing material containing volatile tobacco flavour compounds which are released from the aerosol-forming substrate upon heating. Alternatively or in addition, the aerosol-forming substrate may comprise a non-tobacco material. In the first, second, third and fourth aspects of the invention, preferably, the aerosol-forming substrate further comprises a suitable aerosol former. The aerosol former may be any suitable known compound or mixture of compounds that, in use, facilitates formation of a dense and stable aerosol and that is substantially resistant to thermal degradation at the operating temperature. Suitable aerosol formers are well known in the art and include, for example, polyhydric alcohols, esters of polyhydric alcohols, such as glycerol mono-, di- or triacetate, and aliphatic esters of mono-, di- or polycarboxylic acids, such as dimethyl dodecanedioate and dimethyl tetradecanedioate. Preferred aerosol formers for use in smoking articles according to the invention are polyhydric alcohols or mixtures thereof, such as triethylene glycol, 1,3-butanediol and, most preferred, glycerine. Another suitable aerosol former is propylene glycol.

In each of the aspects of the invention, the aerosol-forming substrate is preferably a solid aerosol-forming substrate. The solid aerosol-forming substrate may comprise, for example, one or more of: powder, granules, pellets, shreds, spaghettis, strips or sheets containing one or more of: herb leaf, tobacco leaf, fragments of tobacco ribs, reconstituted tobacco, homogenised tobacco, extruded tobacco and expanded tobacco. The solid aerosol-forming substrate may be in loose form, or may be provided in a suitable container or cartridge. Optionally, the solid aerosol-forming substrate may contain additional tobacco or non-tobacco volatile flavour compounds, to be released upon heating of the aerosol-forming substrate.

In each of the aspects of the invention, optionally, the solid aerosol-forming substrate may be provided on or embedded in a thermally stable carrier. In a preferred embodiment, the carrier is a tubular carrier having a thin layer of the solid aerosol-forming substrate deposited on its inner surface, or on its outer surface, or on both its inner and outer surfaces. Such a tubular carrier may be formed of, for example, a paper, or paper like material, a non-woven carbon fibre mat, a low mass open mesh metallic screen, or a perforated metallic foil or any other thermally stable polymer matrix. Alternatively, the carrier may take the form of powder, granules, pellets, shreds, spaghettis, strips or sheets.

In each of the aspects of the invention, the solid aerosol-forming substrate may be deposited on the surface of the carrier in the form of, for example, a sheet, foam, gel or slurry. The solid aerosol-forming substrate may be deposited on the entire surface of the carrier, or alternatively, may be deposited in a pattern in order to provide a non-uniform flavour delivery during use.

In each of the aspects aspect of the invention, alternatively, the carrier may be a non-woven fabric or fibre bundle into which tobacco components have been incorporated. The non-woven fabric or fibre bundle may comprise, for example, carbon fibres, natural cellulose fibres, or cellulose derivative fibres.

In each of the aspects of the invention, alternatively, the aerosol-forming substrate may be a liquid aerosol-forming substrate. If a liquid aerosol-forming substrate is provided, the electrically heated smoking system preferably comprises means for retaining the liquid. For example, the liquid aerosol-forming substrate may be retained in a container. Alternatively or in addition, the liquid aerosol-forming substrate may be absorbed into a porous carrier material. The porous carrier material may be made from any suitable absorbent plug or body, for example, a foamed metal or plastics material, polypropylene, terylene, nylon fibres or ceramic. The liquid aerosol-forming substrate may be retained in the porous carrier material prior to use of the electrically heated smoking system or alternatively, the liquid aerosol-forming substrate material may be released into the porous carrier material during, or immediately prior to use. For example, the liquid aerosol-forming substrate may be provided in a capsule. The shell of the capsule preferably melts upon heating and releases the liquid aerosol-forming substrate into the porous carrier material. The capsule may optionally contain a solid in combination with the liquid.

In each of the aspects of the invention, during operation, the aerosol-forming substrate may be completely contained within the aerosol generating device. In that case, a user may puff on a mouthpiece of the electrically heated smoking system. Alternatively, during operation, the aerosol-forming substrate may be partially contained within the electrically heated smoking device. In that case, the aerosol-forming substrate may form part of a separate article and the user may puff directly on the separate article.

In each aspect of the invention, the electrically heated smoking device may further comprise a sensor to detect air flow indicative of a user taking a puff. In that embodiment, preferably, the sensor is connected to the power supply and the system is arranged to energise the at least one heater when the sensor detects a user taking a puff. Alternatively, the system may further comprise a manually operable switch, for a user to initiate a puff.

In each of the aspects of the invention, the device may include a power supply. In one preferred embodiment, the power supply is a DC voltage source. In one embodiment, the power supply is a Lithium-ion battery. Alternatively, the power supply may be a Nickel-metal hydride battery, a Nickel cadmium battery or a Lithium Phosphate battery.

In each aspect of the invention, the electrically heated smoking device may further comprise an interface. The interface may alternatively or additionally facilitate other functionality and features for the smoking system. For that purpose, the connection may be a wired connection (such as a USB connection) or a wireless connection (such as a Bluetooth connection). Preferably, the interface facilitates bi-directional communication between the secondary unit and an intelligent device or host that has its own computing capability and is capable of acting as the primary power supply. This may allow data to be downloaded from the intelligent device or host to the secondary unit and data to be uploaded from the secondary unit to the intelligent device or host.

Features described in relation to one aspect of the invention may also be applicable to another aspect of the invention.

BRIEF DESCRIPTION OF THE DRAWINGS

An embodiment of the invention will further be described, by way of example only, with reference to the accompanying drawings, in which.

DETAILED DESCRIPTION

Figure 1:
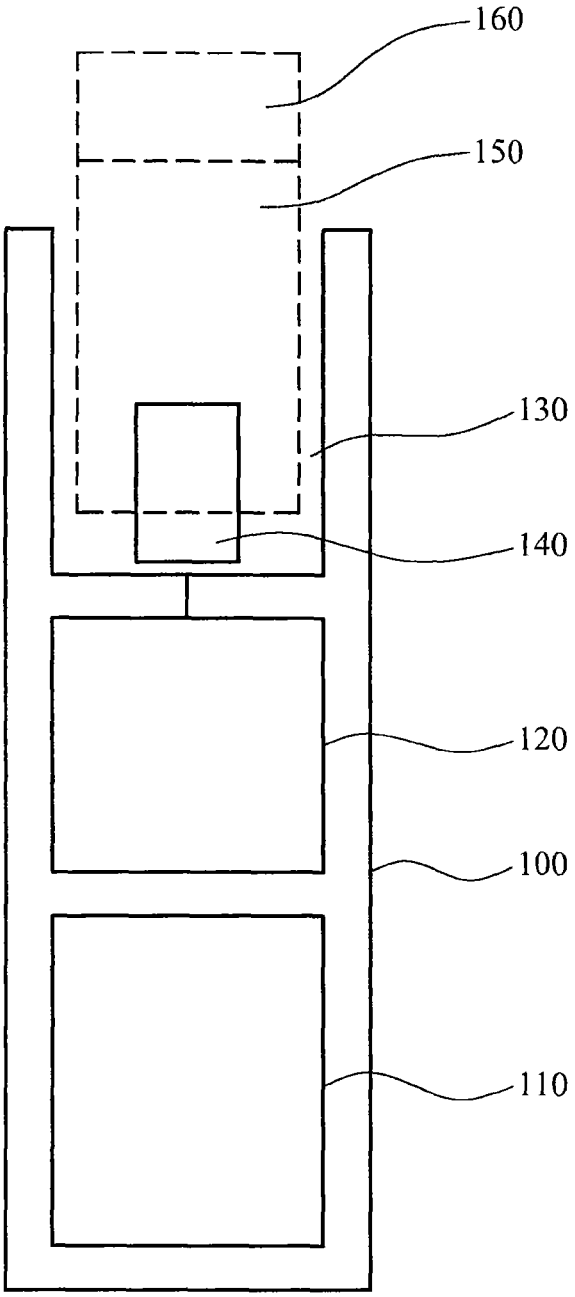
FIG. 1 is a schematic view of the basic elements of an aerosol-generating device in accordance with the invention.

FIG. 1 is a schematic illustration of an electrically powered smoking device. The device comprises a housing 100 containing a battery 110, control electronics 120 and a heater 140, together with a positioning mechanism for moving the heater. The heater 140 is positioned within a socket 130 configured to receive a consumable element 150 containing an aerosol-forming substrate. The consumable element also comprises a filter element 160 through which a user inhales aerosol formed in the device. The aerosol-forming substrate is heated by the heater and releases vaporized flavor compounds. The vapors nucleate to form an aerosol, which is drawn through the filter 160 by a user inhalation.

The heater is configured and controlled to provide short bursts of heat on a per-puff basis. The heater heats a new portion of the aerosol-forming substrate for each puff, to ensure that the desired amount and desired characteristics of aerosol are achieved.

Figure 2:
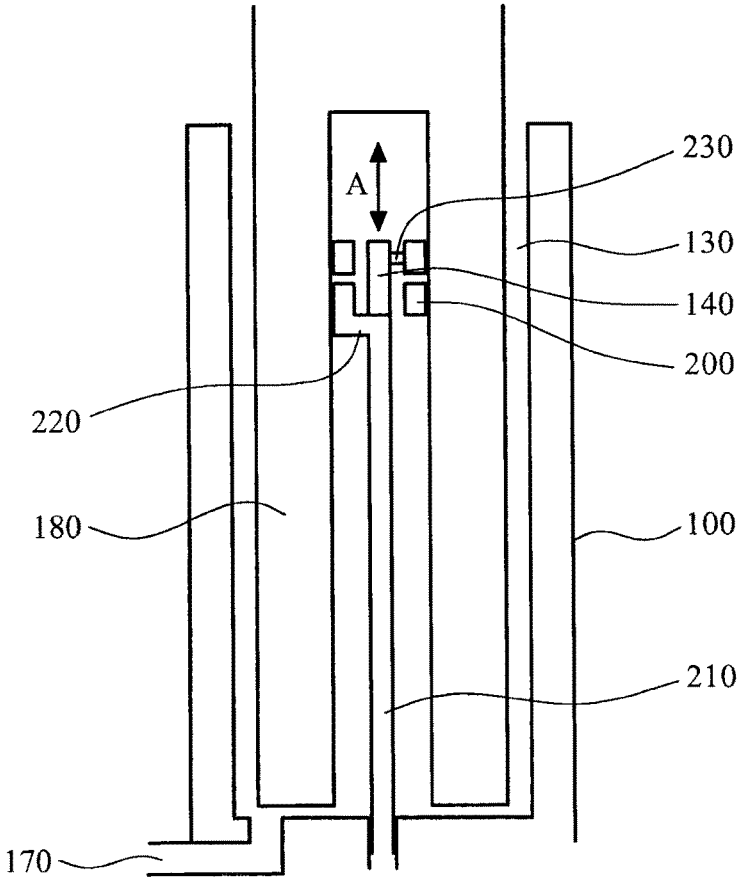
FIG. 2 is a schematic representation of an aerosol-generating device according to one embodiment of the invention.
Figure 3:
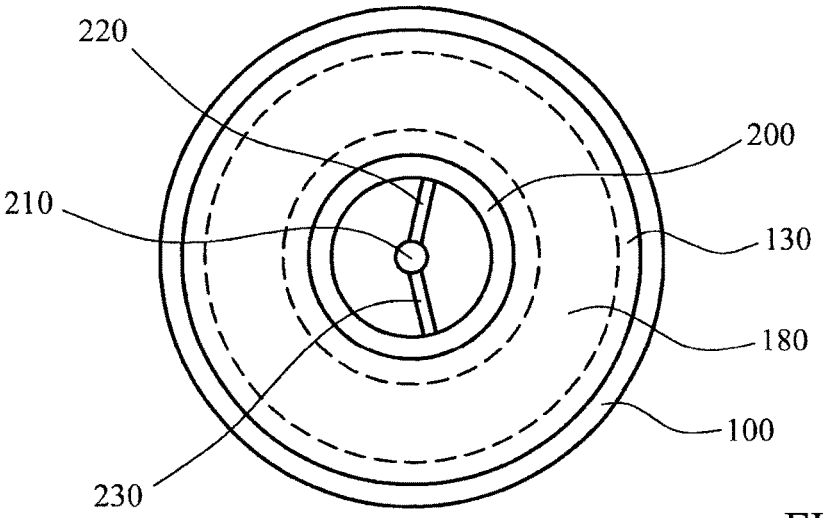
FIG. 3 is schematic cross section of the device of FIG. 2.

FIGS. 2 and 3 show the heater arrangement of FIG. 1 is more detail. The heater 140 is positioned and configured to be received in a cavity within the aerosol-forming substrate. The cavity includes an air inlet 170. The aerosol-forming substrate 180 is formed in a tubular shape and defines an internal bore having a longitudinal axis. A flow sensor is also provided to detect the air flow through the device. The heater 140 comprises a substantially ring shaped or circular heating element 200 mounted on a support 210. The heating element 200 in this example has a helical shape. A positioning mechanism is configured to move the heating element longitudinally in the direction of arrow A. This may be achieved by moving the heating element 200 alone or by moving the support column 210. A more detailed description of one particular arrangement is provided below with reference to FIG. 6.

The positioning mechanism includes an engagement mechanism for moving the heating element towards and away from the aerosol-forming substrate during a positioning process. FIG. 3 is a cross-sectional view through the heating element of FIG. 2 and illustrates the engagement mechanism. One end of the heating element 200 is connected to the support 210 by a first radial arm 220 and the other end of the heating element by a second radial arm 230. Rotation of the first and second radial arms 220 and 230 relative to one another changes the radius of curvature of the heating element 200, so that the heating element can be radially expanded and contracted. In a first, expanded position, the heating element is in contact with the aerosol-forming substrate along substantially its entire length. In a second, retracted position, the heating element 200 is spaced from the aerosol-forming substrate, allowing it to be more easily moved in the longitudinal direction. The relative rotation of the first and second radial arms may be achieved by rotating one arm and keeping the other fixed relative to the housing, or by rotating both arms, simultaneously or sequentially.

Electrical power is supplied to the heating element 200 through the support 210. The support itself may be formed fully or partially from conductive material, or a separate conductive path may be provided on or within the support 210.

Figure 4:
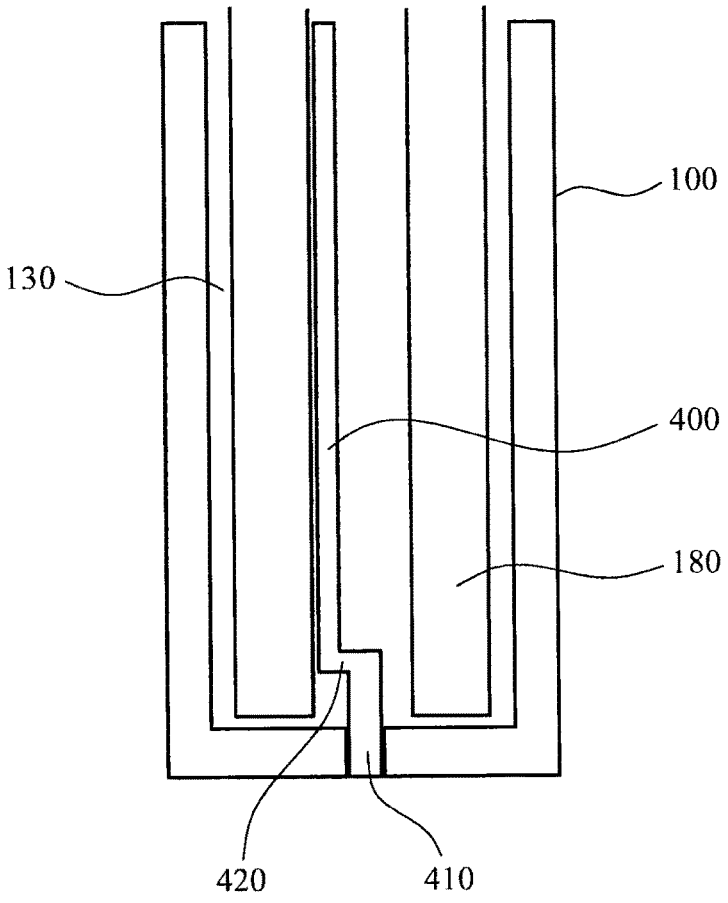
FIG. 4 is a schematic representation of an aerosol-generating device according to another embodiment of the invention.

FIG. 4 is a schematic illustration of an alternative heater arrangement and positioning mechanism in accordance with the invention. The heater of FIG. 4 comprises an elongate heating element 400 mounted on support 410 and radial arms 420. The heating element 400 is configured to heat a section of the aerosol-forming substrate along substantially the entire length of the bore. The heating element is rotated to heat different sections of the aerosol-forming substrate by the positioning mechanism, which comprises support 410 and a stepper motor (not shown) for rotating the support.

The heating element 400 in FIG. 4 is shown in contact with the aerosol-forming substrate 180. The heating element may be retracted by an engagement mechanism configured to move the arms 420 away from the aerosol-forming substrate using an electromagnetic actuator.

Electrical power is supplied to the heating element 400 through the support 410. The support itself may be formed fully or partially from conductive material, or a separate conductive path may be provided on or within the support 410.

Figure 5:
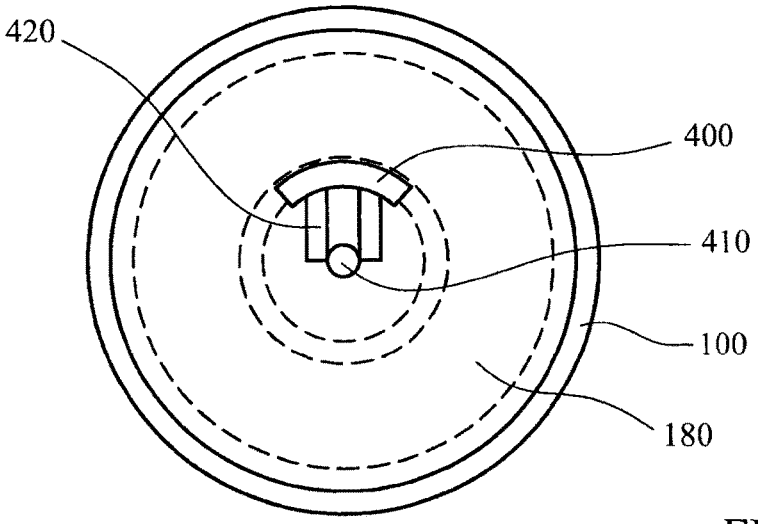
FIG. 5 is a schematic cross-section of the device of FIG. 4.

FIG. 5 is an end view of the heater arrangement of FIG. 4.

Figure 6:
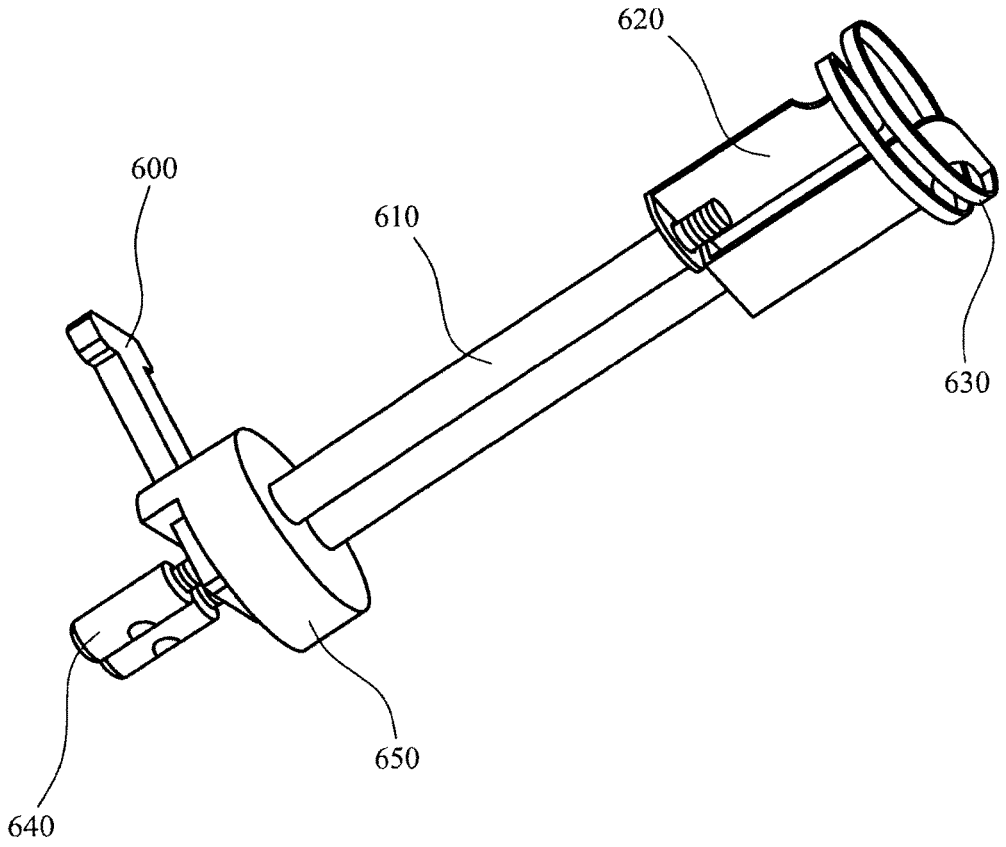
FIG. 6 is a perspective view of a heater assembly in accordance with the embodiment of FIG. 2.

FIG. 6 shows an engagement mechanism for expanding and contracting a heating element of the type shown in FIGS. 2 and 3. The engagement mechanism includes a push button 600. Depression of the button 600 applies a rotation to support rods 610. The engagement mechanism is configured such that it applies rotation to one rod in an opposite sense to the other rod. The rotational movement is transmitted to the torsion bars 620, which are fixed to either end of a helical heating element 630. The torsion bars and support rods are stiffer than the heating element. The rotation of the torsion bars increases the angular distance traveled by the heating element and so reduces the diameter of the helical heating element. With the button 600 depressed the heating element 630 is therefore spaced apart from the aerosol-forming substrate and can be moved in a longitudinal direction to a new position without frictional interference with the aerosol-forming substrate.

When the button is released, the resilient heating element 630 springs back to its original shape and so once again contacts the aerosol-forming substrate. Additional biasing means may be provided within the button mechanism if required. Electrical contacts 640 are spring biased into contact with the support rods 610 so that electrical contact is maintained while allowing the support rods to rotate.

The heating element is moved longitudinally using a manually operated longitudinal positioning mechanism. The whole assembly shown in FIG. 6 may be moved within the housing of the device. Flexible wiring may be used to provide the electrical contact between contacts 640 and electrical contacts fixed to the housing (not shown) so that longitudinal movement of the assembly can be accommodated while still allowing for a supply of electrical power. The longitudinal movement of the assembly may be a simple sliding movement of the support element 650 along an internal bore of the housing. A resilient arm or protrusion may be provided on the support element for engagement with features on the internal surface of the bore to provide a clicking noise as they pass one another. The features on the internal surface of the bore may be spaced apart such that a single clicking noise informs the user that the heating element is adjacent a new, unheated section of the aerosol-forming substrate.

More complex mechanisms for longitudinal movement of the heating element are of course possible including automatic mechanisms that move the heating element longitudinally when button 600 is depressed or following each activation of the heating element or sensed user inhalation. Such automatic mechanisms may be powered by a permanent magnet and solenoid or by a stepper motor for example.

It is also possible to include a position detection mechanism together with a manually operated positioning mechanism in order to prevent heating of the same portion of the aerosol-forming substrate twice. For example, an optical sensor may be incorporated into the assembly or housing to determine the position of the heating element. The microcontroller may then disable the supply of power to the heating element or issue a visible or audible alarm if it is determined to be in a position in which it has already been activated for the current aerosol-forming substrate.

Figure 7:
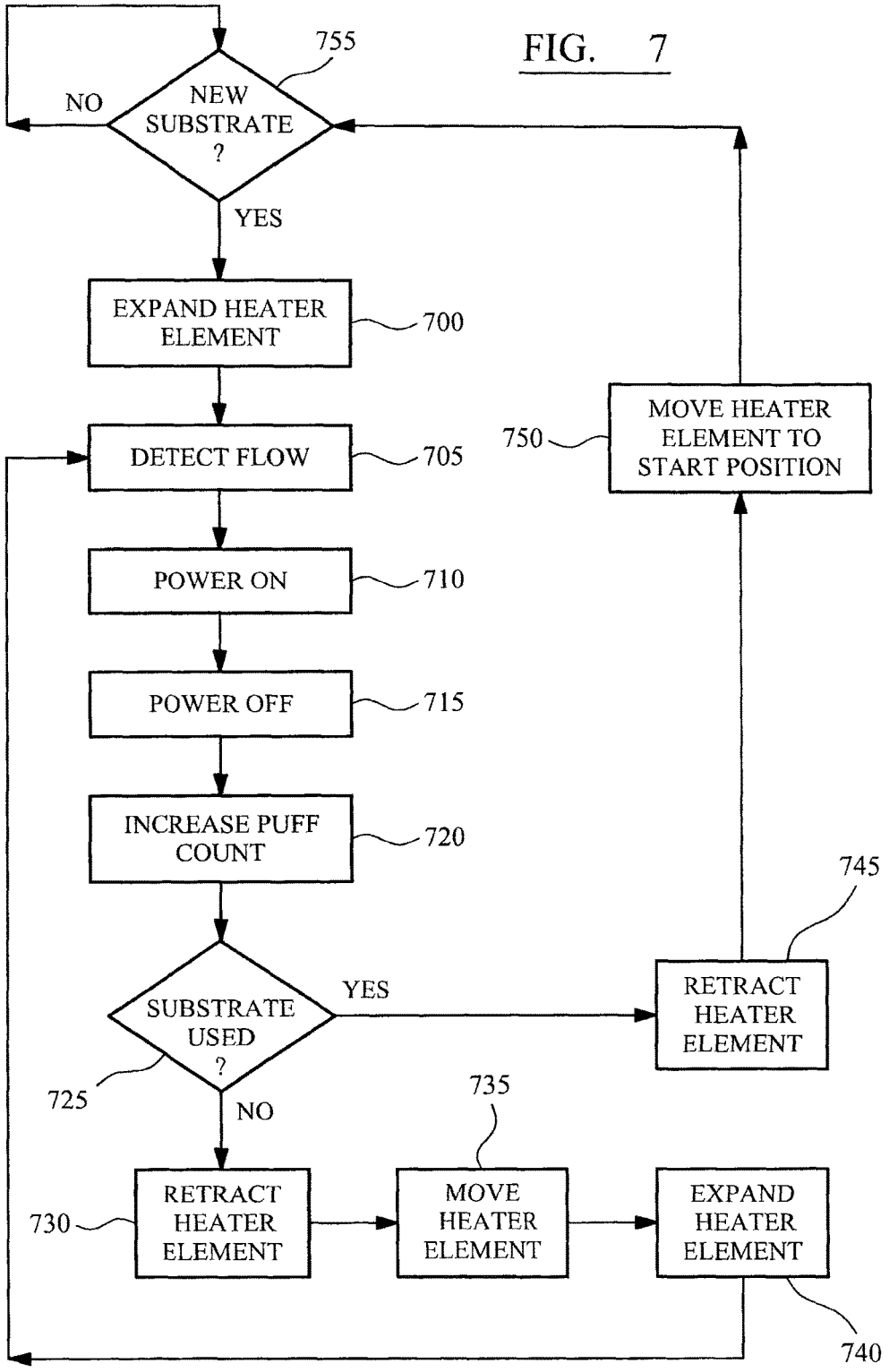
FIG. 7 is a flow diagram illustrating the steps taken during the operation of the device of FIG. 2.

FIG. 7 is a flow diagram illustrating an example of the operation of a heater in accordance with FIGS. 2, 3 and 6. When a new aerosol-forming substrate is to be inserted into the socket, the heating element is in a contracted configuration. In the system shown in FIG. 6, this means that the button 600 is pressed. In step 700, once a new aerosol-forming substrate has been inserted, the heating element is expanded by the engagement mechanism to contact the interior surface of the aerosol-forming substrate. The heating element is positioned as close to the filter end of the aerosol-forming substrate as possible. This minimizes the time to first puff for the user. In step 705, a flow of air through the device is detected by the flow sensor, indicating that a user is taking a puff. Following detection of air flow, the microcontroller supplied power to the heating element in step 710. After a fixed duration or fixed amount of power, the microcontroller switches off the power to the heating element, in step 715.

In step 720, a puff count for the aerosol-forming substrate is incremented. The puff count is used to ensure that only a fixed number of heating cycles are used on each aerosol-forming substrate so that no section of the aerosol-forming substrate is heated twice. The puff count increase can be carried out before, simultaneous with or after the supply of power to the heating element.

In step 725, the microcontroller checks the puff count to determine if the aerosol-forming substrate needs to be replaced. If not, the heating element is moved to a new portion of the aerosol-forming substrate by the positioning mechanism. First, in step 730, the heating element is contracted by pressing the button 600 (or by automatic means). The heating element is then moved longitudinally to new position in step 735, as described with reference to FIG. 7. The new position may be directly adjacent the previous position or may be distant from it. In this example, the heating element is simply moved to an adjacent position, one step further from the filter end of the aerosol-forming substrate. Once in the desired longitudinal position, the button 600 is released and the heating element expands to contact the new portion of the aerosol-forming substrate in step 740. The heating element is then ready to supply the next puff and the process then returns to step 705.

If in step 725 the microcontroller determines that all available areas of the aerosol-forming substrate have been used, then the aerosol-forming substrate must be replaced. A visual or audible indication may be provided to the user. In order to replace the aerosol-forming substrate, the button 600 is pressed to contract the heating element in step 745. The aerosol-forming substrate can then be easily slid out of the device. While the heating element is contracted, it is moved longitudinally to the start position closest to the filter in step 750. To insert a new aerosol-forming substrate, the button remains pressed, or is pressed again if it has been released, to contract the heating element. In step 755, if an automated mechanism is used, the heating element can be held in a contracted state until a new aerosol-forming substrate is detected. Once a new aerosol-forming substrate is detected the process begins again at step 700.

The invention claimed is:

1. An aerosol generating device, comprising:

a housing configured to receive an aerosol-forming substrate having an internal cavity;

a heating element configured to be received within the internal cavity of the aerosol-forming substrate; and a positioning mechanism coupled to the heating element, the positioning mechanism being configured to move the heating element between a plurality of positions within the internal cavity.

2. The device according to claim 1, wherein the positioning mechanism further comprises an engagement mechanism configured to move the heating element towards and away from an interior surface of the internal cavity.

3. The device according to claim 2, wherein the engagement mechanism is configured to move the heating element into and out of contact with the interior surface of the internal cavity.

4. The device according to claim 1, wherein the aerosol-forming substrate is tubular such that the internal cavity is a bore having a longitudinal axis, wherein the device is configured to receive the tubular aerosol-forming substrate, and wherein the positioning mechanism is configured to move the heating element in a longitudinal direction.

5. The device according to claim 1, wherein the heating element is ring shaped or circular.

6. The device according to claim 5, wherein the heating element is resilient, wherein the positioning mechanism further comprises an engagement mechanism configured to move the heating element towards and away from an interior surface of the internal cavity, and wherein the engagement mechanism is attached to at least one end of the heating element, and is configured to move that end of the heating element in a circumferential direction to radially expand or contract the heating element.

7. The device according to claim 1, further comprising a microcontroller configured to control a supply of electrical power to the heating element and to activate the positioning mechanism following the supply of a predetermined amount or duration of electrical power to the heating element.

8. The device according to claim 1, wherein the positioning mechanism is configured to conduct electricity to the heating element.

9. The device according to claim 1, comprising a plurality of heating elements, wherein the positioning mechanism is configured to move each heating element of the plurality.

10. An aerosol generating device, comprising:

a housing configured to receive an aerosol-forming substrate;

a heating element configured to heat a portion of the aerosol-forming substrate; and a positioning mechanism configured to move the heating element from a first position next to a first portion of the aerosol-forming substrate, to a second position spaced apart from the aerosol-forming substrate, and then to a third position next to a second portion of the aerosol-forming substrate.

11. The device according to claim 10, wherein the aerosol-forming substrate is tubular or cylindrical and defines a longitudinal axis, wherein the housing is configured to receive the tubular or cylindrical aerosol-forming substrate, and wherein the third position is longitudinally removed from the first position.

12. The device according to claim 10, wherein the heating element is positioned externally of the aerosol-forming substrate in the first, second, or third positions.

13. The device according to claim 10, wherein the aerosol-forming substrate comprises a tubular portion, wherein the device is configured to receive the aerosol-forming substrate comprising the tubular portion, and wherein the heating element is configured to be positioned internally of the tubular portion in the first and third positions.

14. The device according to claim 10, wherein the heating element is ring shaped or circular.

15. The device according to claim 10, comprising a plurality of heating elements, wherein the positioning mechanism is configured to move each heating element of the plurality.

16. A method of heating an aerosol-forming substrate, comprising:

moving a heating element into contact with or close to a first portion of a surface of the aerosol-forming substrate;

activating the heating element to heat the first portion of the surface of the aerosol-forming substrate;

moving the heating element away from the surface of the aerosol-forming substrate;

moving the heating element into contact with or close to a second portion of the surface of the aerosol-forming substrate; and activating the heating element to heat the second portion of the surface of the aerosol-forming substrate.

* * * * *